United States Patent [19]

Kinoshita

[11] Patent Number: 4,912,507

[45] Date of Patent: Mar. 27, 1990

[54] ELECTROPHOTOGRAPHIC COPYING APPARATUS FOR FORMING AN IMAGE WITHOUT ANY UNNECESSARY SHADOW REGION

[75] Inventor: Naoyoshi Kinoshita, Osaka, Japan

[73] Assignee: Minolta Camera Kabushiki Kaisha, Osaka, Japan

[21] Appl. No.: 247,262

[22] Filed: Sep. 21, 1988

[30] Foreign Application Priority Data

Sep. 21, 1987 [JP] Japan ..... 62-238523
Sep. 21, 1987 [JP] Japan ..... 62-238524

[51] Int. Cl.[4] ..... G03G 21/00; G03G 15/02; G03G 15/06; G03G 27/32

[52] U.S. Cl. ..... 355/203; 355/218; 355/225; 355/266; 355/25

[58] Field of Search ..... 355/203, 204, 208, 218, 355/219, 225, 230, 231, 245, 260, 266, 326, 25

[56] References Cited

U.S. PATENT DOCUMENTS 3,960,445 6/1976 Drawe .
3,967,891 7/1976 Rippstein .
4,579,443 4/1986 Abuyama et al. ..... 355/326 X
4,657,376 4/1987 Ide .
4,666,290 5/1987 Yoshiura ..... 355/245 X
4,745,437 5/1988 Oka .
4,785,331 11/1988 Oka .
4,792,775 12/1988 Oka et al. .
4,794,062 12/1988 Oka et al. .
4,803,521 2/1989 Honda ..... 355/245 X
4,821,071 4/1989 Oka et al. ..... 355/210
4,821,076 4/1989 Toyoshi .
4,828,953 5/1989 Oka .
4,835,566 5/1989 Oka .

FOREIGN PATENT DOCUMENTS 51-134635 11/1976 Japan .
54-30833 3/1979 Japan .
61-38967 2/1986 Japan ..... 355/25
63-124058 5/1988 Japan ..... 355/225
63-124062 5/1988 Japan ..... 355/225

*Primary Examiner*—A. T. Grimley
*Assistant Examiner*—E. J. Pipala
*Attorney, Agent, or Firm*—Wenderoth, Lind & Ponack

[57] ABSTRACT

An electrophotographic copying apparatus comprises an image forming unit for forming an image of an original to be copied, and a developing device for transferring the image onto copy paper, the image forming unit including a scorotron charger for representing only outlines of the original image. When the original is copied with a cover being not placed thereon, a shadow would be usually formed in an area corresponding to the portion not covered; however, the scorotron charger forms an outline image of this shadow and accordingly no shadow is formed in the area corresponding to the portion not covered.

21 Claims, 13 Drawing Sheets

ELECTROPHOTOGRAPHIC COPYING APPARATUS FOR FORMING AN IMAGE WITHOUT ANY UNNECESSARY SHADOW REGION

CROSS-REFERENCE TO RELATED, COPENDING APPLICATIONS

Related, copending applications of particular interest to the instant application are U.S. Pat. Application Ser. No. 016,716, entitled "Method for the Formation of Outline Images Corresponding to the Peripheral Outlines of Document's Images" and U.S. Pat. Application Ser. No. 016,717, entitled "Method for the Formation of Outline Images Corresponding to the Peripheral Outlines of Document's Images", both filed Feb. 19, 1987 and assigned to the same assignee of the present invention.

BACKGROUND OF THE INVENTION

1. Field of the Invention

The present invention relates to an electrophotographic copying apparatus and, more specifically, to an electrophotographic copying apparatus capable of forming an image without unnecessary shadow region.

2. Description of the Prior Art

In a conventional copying apparatus, black shadow regions are formed around a copy image if copy is carried out with a document cover being opened. If a book is copied, a black shadow region is formed in an area corresponding to the binding margin of the book.

Those shadow regions are very unpleasant to the sight and, in addition, toner is considerably consumed for the formation thereof.

SUMMARY OF THE INVENTION

Therefore, an object of the present invention is to provide an electrophotographic copying apparatus without additionally requiring any special device, in which any unnecessary shadow regions do not appear in a copy image if copy is carried out with a document cover being opened.

Another object of the present invention is to provide an electrophotographic copying apparatus in which any shadow is not formed in a binding margin area if an original to be copied is a book.

Another object of the present invention is to provide an electrophotographic copying apparatus in which an applicable range of an image forming process using a scorotron charger is broadened.

A further object of the present invention is to provide an electrophotographic copying apparatus which has an economical merit.

A further object of the present invention is to provide an electrophotographic copying apparatus including a demountable outline image forming unit.

In order to accomplish the above described objects, an electrophotographic copying apparatus according to the present invention comprises: a photoreceptor drum for forming an electrostatic latent image; a document placing table on which a document is to be placed, the document including an original image to be copied; a document cover to be opened and closed on the document placing table; cover detection means for detecting an opened or closed state of the document cover; electrostatic latent image forming means for forming, on the photoreceptor drum, an electrostatic latent image corresponding to the original image of the document placed on the document placing table; outline forming means provided in a position opposed to the photoreceptor drum, for forming only outlines of the original image; and control means for enabling the outline forming means to effect outline copy of the original image when the cover detection means detects the opened state of the cover.

Since the electrophotographic copying apparatus comprises the above described components, when a document is copied with the document cover being opened, shadows are not formed substantively around the normally formed image and only outlines thereof are formed. As a result, the electrophotographic copying apparatus according to the present invention makes it possible to form no shadows in the copy image even if the copy is made with the document cover being opened.

According to a preferred embodiment of the present invention, the outline forming means comprises an outline forming unit for forming outlines of the original image, a unit mounting portion for mounting the outline forming unit in a position opposed to the photoreceptor drum, and unit detection means for detection as to whether the outline image forming unit is mounted in the unit mounting portion, and the outline forming unit includes a scorotron charger for applying charge to the photoreceptor drum corresponding to outline portions of the original image, the scorotron charger being enabled by the control means when the unit detection means detects mounting of the outline forming unit.

In the electrophotographic copying apparatus according to the present invention, the outline forming unit includes the scorotron charger as described above. Accordingly, an applicable range of an image forming process using the scorotron charger is broadened.

According to another preferred embodiment of the present invention, the electrophotographic copying apparatus further comprises a developing unit for forming normal images other than outline images and the developing unit can be mounted in the unit mounting portion, in place of the outline forming unit.

The electrophotographic copying apparatus comprises the above described components and accordingly the outline forming unit is demountable. Thus, it is made possible to provide the electrophotographic copying apparatus including the demountable outline forming unit.

Since the outline forming unit is demountable, it can be purchased as required. Thus, the electrophotographic copying apparatus not provided with the outline forming unit can be purchased at first. Accordingly, the electrophotographic copying apparatus has an economical advantage.

According to a further embodiment of the present invention, an electrophotographic copying apparatus capable of forming an image with outline portions intensified by applying a desired charge by a scorotron charger to an electrostatic latent image formed on a photoreceptor drum, comprises: a document placing table on which an original is to be placed, the original including a book having a binding margin; book signal generating means for generating a book signal indicating that the original is a book, the book including an original image; electrostatic latent image forming means for forming, on the photoreceptor drum, the electrostatic latent image corresponding to the original image on the document placing table; outline forming means provided in a position opposed to the photoreceptor drum, for forming only outlines of the original image; and control means for enabling the outline forming means with respect to an area of the binding margin of the book to form the outlines of the original image when the book signal generating means generates the book signal.

Since the electrophotographic copying apparatus according to the present invention comprises the above described components, when a book is copied, a shadow is not formed corresponding to the binding margin area of the book and only outlines thereof are formed. Accordingly, if a book is copied, the electrophotographic copying apparatus is capable of forming an image with no shadow appearing corresponding to the binding margin area of the book.

According to a further preferred embodiment of the present invention, a book as an original to be copied includes a first page and a second page facing each other, and the electrophotographic copying apparatus includes book division copy mode designation input means for designating a book division copy mode in which the first and second pages are copied on different sheets of copy paper.

Since the electrophotographic copying apparatus according to the present invention comprises the above described components, if original images for two facing pages are copied separately on different sheets of copy paper, unnecessary shadow regions do not appear on the copy images. Thus, an applicable range of an image forming process for forming outline images in the electrophotographic copying apparatus is broadened.

The foregoing objects and other objects, features, aspects and advantages of the present invention will become more apparent from the following detailed description of the present invention when taken in conjunction with the accompanying drawings.

DESCRIPTION OF THE PREFERRED EMBODIMENTS

First of all, an image forming principle of an outline image forming method applied to the present invention will be briefly described.

Figure 1:
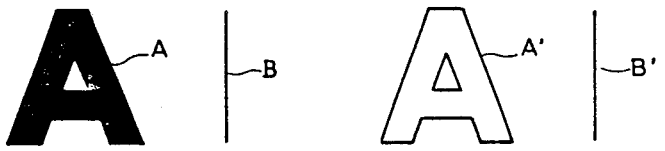
FIG. 1 is an illustration showing an original image and an outline image formed from the original image.

A so-called outline image forming method for forming an outline image A′ by extracting only outlines from an area image A and reproducing a line image B′ as it is from a line image B as shown in FIG. 1 is disclosed in U.S. Pat. Application Ser. No. 016,716 and U.S. Pat. Application Ser. No. 016,717 both filed Feb. 19, 1987 and assigned to the same assignee of the present invention.

Figure 2:
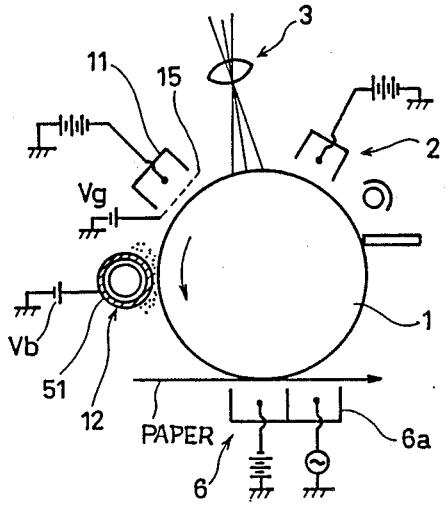
FIG. 2 is a typical view showing, in an enlarged manner, a photoreceptor drum and its surrounding portions.
Figure 3:
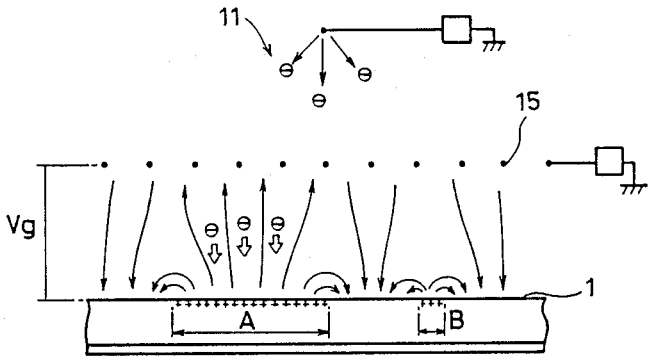
FIG. 3 is a typical illustration showing electric force lines in a charging process for forming outline images.
Figure 4A:
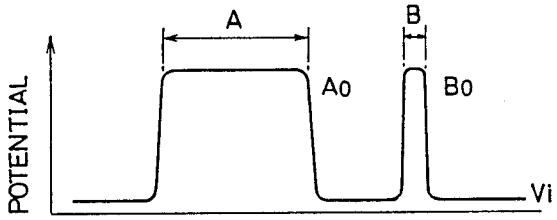
FIGS. 4A to 4C represent potentials of electrostatic latent images.
Figure 4B:
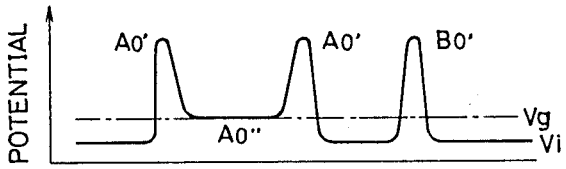

This outline image forming method will be described with reference to FIGS. 2 to 4. FIG. 2 is a typical view showing a photoreceptor drum and its surrounding components; FIG. 3 is an illustration showing electric force lines in a charging process for outline image formation; and FIGS. 4A to 4C are illustrations showing potentials of electrostatic latent images.

Referring to FIG. 2, the surface of the photoreceptor drum 1 rotating in the direction of the arrow is uniformly charged by a corona charger 2 and then it is exposed to an image by means of an exposure device 3. Thus, electrostatic latent images Ao and Bo are formed corresponding to the area image A and the line image B for example as shown in FIG. 4A.

Subsequently, a high voltage is applied to a charge wire of the scorotron charger 11 of an outline forming unit **8*a* to be described later and, at the same time, a grid voltage Vg lower than the surface potential of the electrostatic latent images Ao and Bo is applied to a grid 15. As a result, as shown in FIG. 4B**, as for the electrostatic latent image Ao of the area image portion, a potential Ao″ in the portion excluding the outline portions Ao′ is lowered to the grid voltage Vg, while as for the electrostatic latent image Bo of the line image portion, almost the same electrostatic latent image Bo′ is maintained.

Figure 4C:
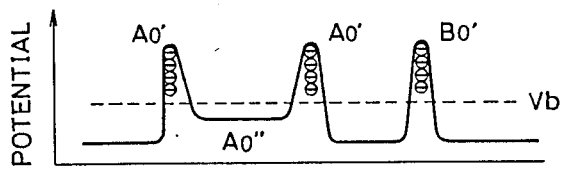

Then, toner is supplied to the electrostatic latent images Ao′ and Bo′ in a portion opposed to the developing unit 12 from a developer sleeve 51 to which a development bias voltage Vb higher than the grid voltage Vg is supplied, as shown in FIG. 4C. After that, the toner images are transferred to copy paper P, whereby an outline image with outlines being extracted is obtained as shown on the right side of FIG. 1.

Now, an apparatus of the present invention utilizing the above described principle will be described.

Figure 5:
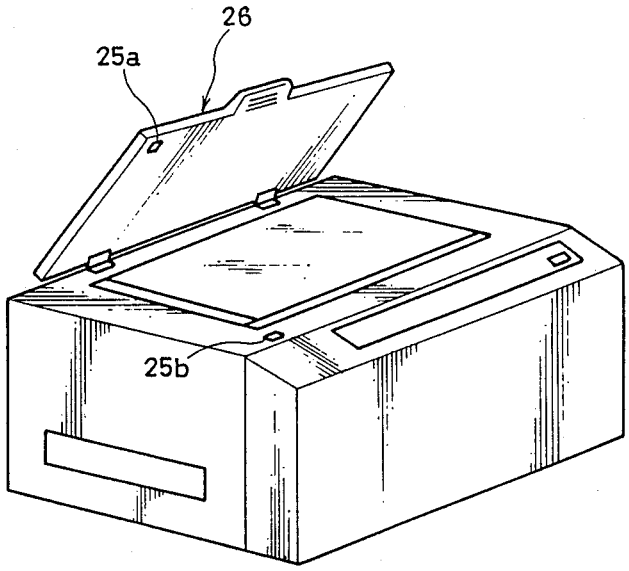
FIG. 5 is a view showing an appearance of a copying apparatus to which the present invention is applied.
Figure 6:
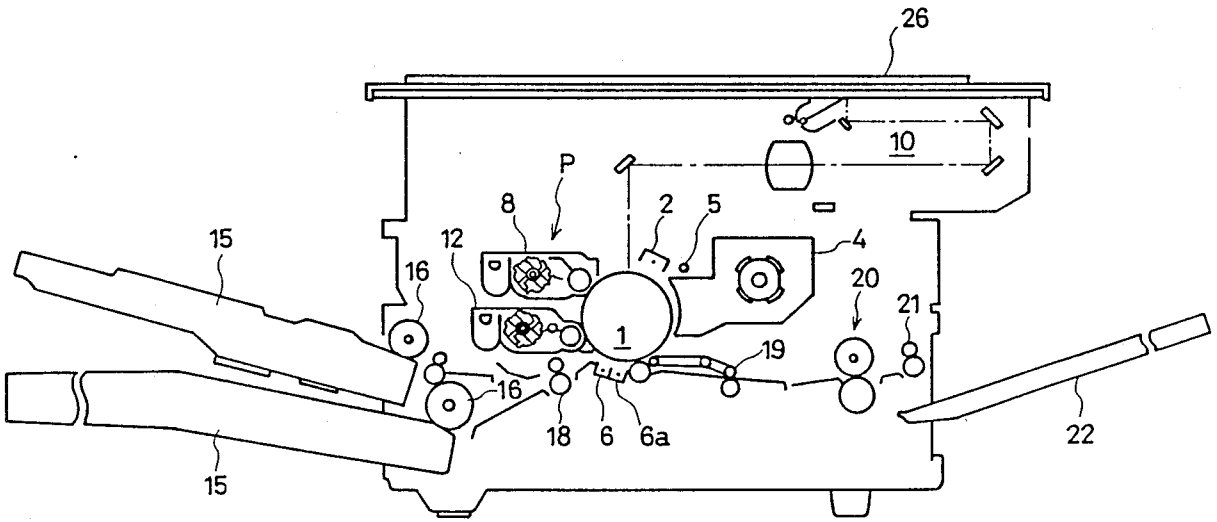
FIG. 6 is a sectional view showing a schematic construction of a copying apparatus to which the present invention is applied.
Figure 7:
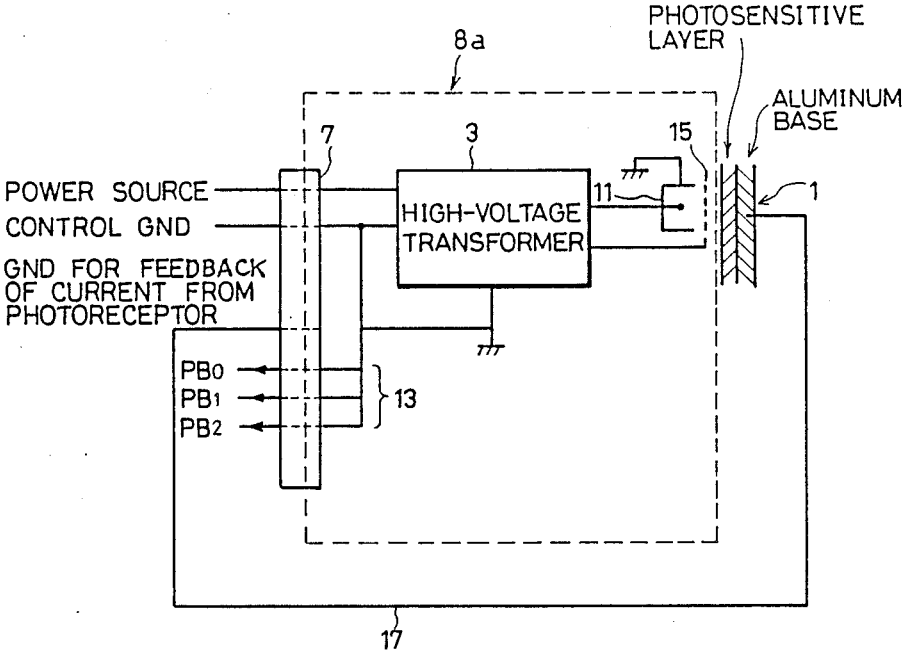
FIG. 7 is a schematic diagram showing an outline forming unit.

FIG. 5 is a view showing an appearance of a copying apparatus to which the present invention is applied and FIG. 6 is a sectional view schematically showing a construction of the copying apparatus.

A document cover 26 to be opened and closed is provided on an upper surface of a main body of the copying apparatus. An opened or closed state of the document cover 26 is detected by contact switches 25*a* and 25*b*.

Referring to FIG. 6, a main motor, not shown, is provided in the copying apparatus and this motor drives a photoreceptor drum 1, paper feed rollers 16, a timing roller pair 18, a first developing unit 8, a second developing unit 12, a transport portion 19, a fixing device 20, a discharge roller pair 21 etc.

The respective feed rollers 16, the timing roller pair 18 and the respective developing units 8 and 12 are individually driven by the main motor through electromagnetic spring clutches and the like (not shown).

Sheets of paper where a copy image is to be formed are stored in each paper feed cassette 15. The paper is fed by the paper feed roller 16, passes through the timing roller pair 18 and transported through a transfer charger 6 and a separation charger 6*a*. Then, it passes through the fixing device 20 and is discharged onto a discharge tray 22.

The photoreceptor drum 1 comprises a conductive layer of aluminum for example and a photosensitive layer formed thereon.

A cleaning device 4, a main eraser lamp 5, the corona charger 2, the developing units 8 and 12, the transfer charger 6, the separating charger 6*a* and the like are provided around the photoreceptor drum 1. The chained lines in FIG. 6 represent an optical path of an optical system 10. The photoreceptor drum 1 charged as described above by scanning of an original image by the optical system 10 is subjected to exposure of the image, whereby an electrostatic latent image is formed on the photoreceptor drum 1.

Toner is deposited onto the electrostatic latent image by means of the developing unit 8 or 12. The toner image on the photoreceptor drum 1, obtained by the deposition of the toner, is transferred onto paper by means of the transfer charger 6. The timing roller pair 18 delivers the paper fed from the paper feed portion to cause a leading edge of the paper to coincide with a leading edge of the toner image forming region on the photoreceptor drum 1. The toner image is transferred by the transfer charger 6 onto the paper thus delivered. The paper is separated from the surface of the photoreceptor drum 1 by the separation charger 6*a* and then it passes through the transport portion 19 and attains the fixing device 20, where the toner is thermally fixed. Then, the paper is discharged by the discharge roller pair 21 to outside.

The first developing unit 8 is a unit detachably mounted in a mounting portion P of the main body of the copying apparatus. The first developing unit 8 is any one of developing units provided for a plurality of developer colors. Any one of those developing units can be mounted in the mounting portion P. Each of the developing units 8 has a dip switch indicating a 3-bit code. This dip switch notifies the developer color of the developing unit mounted to a microcomputer in the main body of the copying apparatus. The dip switch can be set by a service man or an operator. When the developing unit 8 is mounted in the mounting portion P, a connector of the developing unit is coupled with a connector in the main body of the copying apparatus and a terminal of the dip switch is connected to an input port of tee microcomputer, whereby the 3-bit code signal is inputted to the microcomputer.

In place of the developing unit 8, an outline forming unit 8*a* can be mounted in the mounting portion P. The outline forming unit 8*a* comprises a scorotron charger 11, and a high-voltage transformer 3 for applying a high voltage to the scorotron charger 11. The scorotron charger 11 has a grid electrode 15 in a position to be opposed to the photoreceptor drum 1 when it is mounted in the mounting portion P. When the scorotron charger 11 of the outline forming unit 8*a* is operated, an outline image can be formed with outlines extracted from the original image as described above. The outline forming unit 8*a* has a terminal 13 for applying a 3-bit code signal to the microcomputer in the same manner as in the first developing unit 8. When the outline forming unit 8*a* is mounted in the mounting portion P, the input port of the microcomputer and the above mentioned 3-bit code terminal 13 are connected through a connector 7 to notify the microcomputer that the outline forming unit 8*a* is mounted in the mounting portion P.

Electric current generated on the photoreceptor drum 1 by the operation of the scorotron charger 11 is very unstable and if this current flows into a ground line of the control system, it would cause erroneous operation of the microcomputer. Therefore, this current is directly fed back to the ground of the high-voltage transformer 3 by a ground line 17 through the connector 7.

Figure 8:
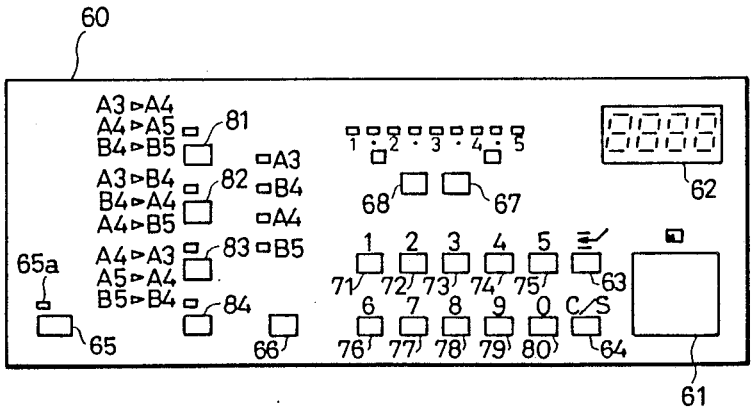
FIG. 8 is a plan view of an operation panel of an electrophotographic copying apparatus according to the present invention.

FIG. 8 is a plan view of an operation panel of an electrophotographic copying apparatus according to the present invention.

The operation panel 60 comprises a print key 61 for starting copy operation, a numerical display portion 62 capable of displaying a numerical value of four digits, ten-key pads 71 to 80, an interruption key 63, a clear stop key 64, a division copy selection key 65, a paper selection key 66 for designating paper of an appropriate size out of paper sheets of different sizes in a plural number of cassettes attached to the main body, an exposure degree up key 67 and an exposure degree down key 68, a group of copying magnification setting keys 81 to 84 etc.

Figure 9:
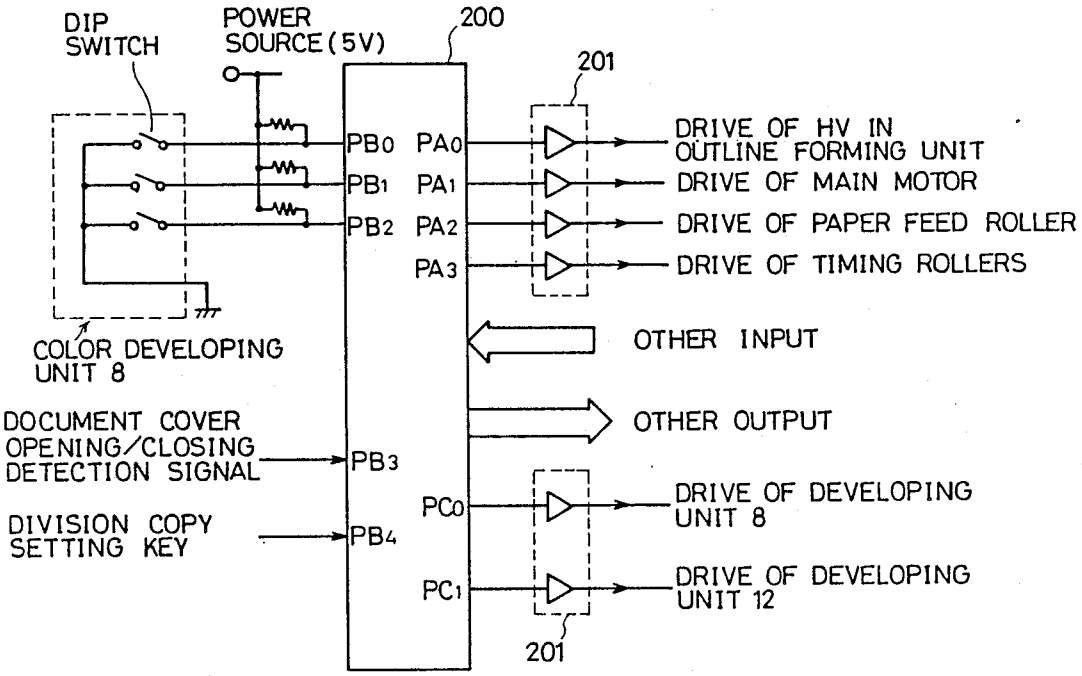
FIG. 9 is a schematic control circuit diagram of the electrophotographic copying apparatus.

FIG. 9 is a schematic control circuit diagram of the electrophotographic copying apparatus according to the present invention, in which a one-chip microcomputer 200 is used. A driver circuit 201 for driving the main motor and the like is connected to the microcomputer 200. Control signals are provided from output ports PA0, PAl, PA2 and PA3 to a drive circuit of a high-voltage power source in the outline forming unit 8*a*, a drive circuit of the main motor, a clutch for driving the paper feed rollers and a clutch for driving the timing roller pair, respectively. Output ports PC0 and PCl provide control signals for controlling clutches for driving the developing units 8 and 12. Input ports PP0 to PP2 are connected to dip switches for setting a developing unit code corresponding to a developer color (toner color) in the first developing unit 8. An input terminal PB3 is an input terminal for entering an opening or closing signal for the document cover 25 and an input terminal PB4 is an input terminal for entering a division copy setting key signal for a book as an original.

Figure 10:
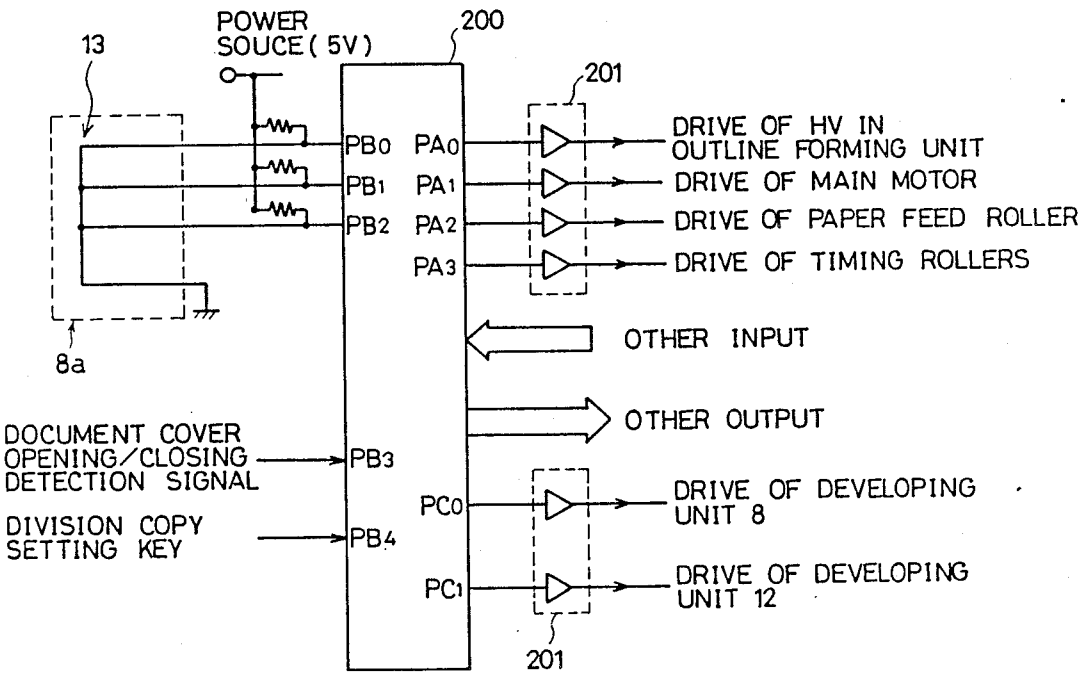
FIG. 10 is a schematic control circuit diagram of the electrophotographic copying apparatus in which an outline forming unit is mounted.

FIG. 10 is a control circuit diagram similar to FIG. 9. FIG. 10 is different from FIG. 9 in that the outline forming unit 8*a* is mounted in the mounting portion P. Low (L) signals are applied to input ports PB0, PB1 and PB2 through the code terminal 13 of the outline forming unit 8*a*.

In the following, a 3-bit code signal applied to the microcomputer will be described.

Identification of a developer color in a developing unit set in the mounting portion P and identification of existence or nonexistence of the outline forming unit can be effected by a code composed of combination of three bits and this code signal is applied to the microcomputer 200. The microcomputer 200 determines which unit is set in the mounting portion P, referring to a table in a memory based on the input code. Table 1 indicates relations between input codes and identified contents.

TABLE 1

| PB0 | PB1 | PB2 | Indentification of Unit Mounted |
|---|---|---|---|
| L | L | L | outline forming unit |
| L | H | L | black developing unit |
| L | H | H | red developing unit |
| H | L | L | blue developing unit |
| H | L | H | green developing unit |
| H | H | L | white developing unit |
| H | H | H | not mounted |

More specifically, Table 1 represents combinations of codes applied from the unit mounted in the mounting portion P to the input ports PB0, PB1 and PB2 of the microcomputer 200 and developer colors of the developing units or existence of the outline forming unit corresponding to the codes. Thus, the developer color in the developing unit mounted and existence or nonexistence of the outline forming unit can be easily detected by the control portion.

For example, if the unit set in the mounting portion P is a developing unit of black color, L, H and L inputs are applied to the input terminals PB0, PB1 and PB2. If the unit set in the mounting portion P is the outline forming unit, L, L and L inputs are applied thereto. Thus, different codes are assigned to the developer colors of the developing units and the outline forming unit, thereby to make it possible to identify the developer colors and existence of the outline forming unit.

As shown in Table 1, existence of the outline forming unit is detected only when the inputs to the ports PB0, PB1 and PB2 are L, L and L, respectively. Thus, the below described disadvantages can be avoided. If an H logic is contained in the outline forming unit identification code, the input connection terminal of the microcomputer of the main body will be pulled up to a level of the power source to receive the H logic even if a defective contact of the connector 7 occurs, and it will be impossible to detect the defective contact.

More specifically, if a defective contact of the connector occurs, electric current generated on the photoreceptor drum 1 by corona discharge of the scorotron charger 11 is not fed back to the ground of the high-voltage transformer 3 and flows to the ground of the control system, which might cause malfunction of the microcomputer 200. Accordingly, in order to avoid the above described disadvantages, the 3-bit code of L, L and L is assigned to the outline forming unit 8*a* having the high-voltage transformer 3 so that a defective contact of the connector can be detected.

Thus, the input ports PB0, PB1 and PB2 are pulled up to the power source 5 V and if the outline forming unit is not mounted, each of those ports is at H level (5 V). The terminal 13, which is grounded, is provided in the outline forming unit 8*a* to cause those ports for identification of the unit to be at L level when the outline forming unit 8*a* is set in the main body.

In the above described manner, the input ports for identification of the unit are all at L level only when the outline forming unit is set in the main body, and it is determined that the ground line 17 for feedback from the photoreceptor drum is also connected because of the connection of those ports. On the other hand, if the outline forming unit is not properly set in the main body, one or more ports for identification are at H level, to prevent selection of an outline forming mode. [Main Routine for Control of Copy Operation]

Figure 11:
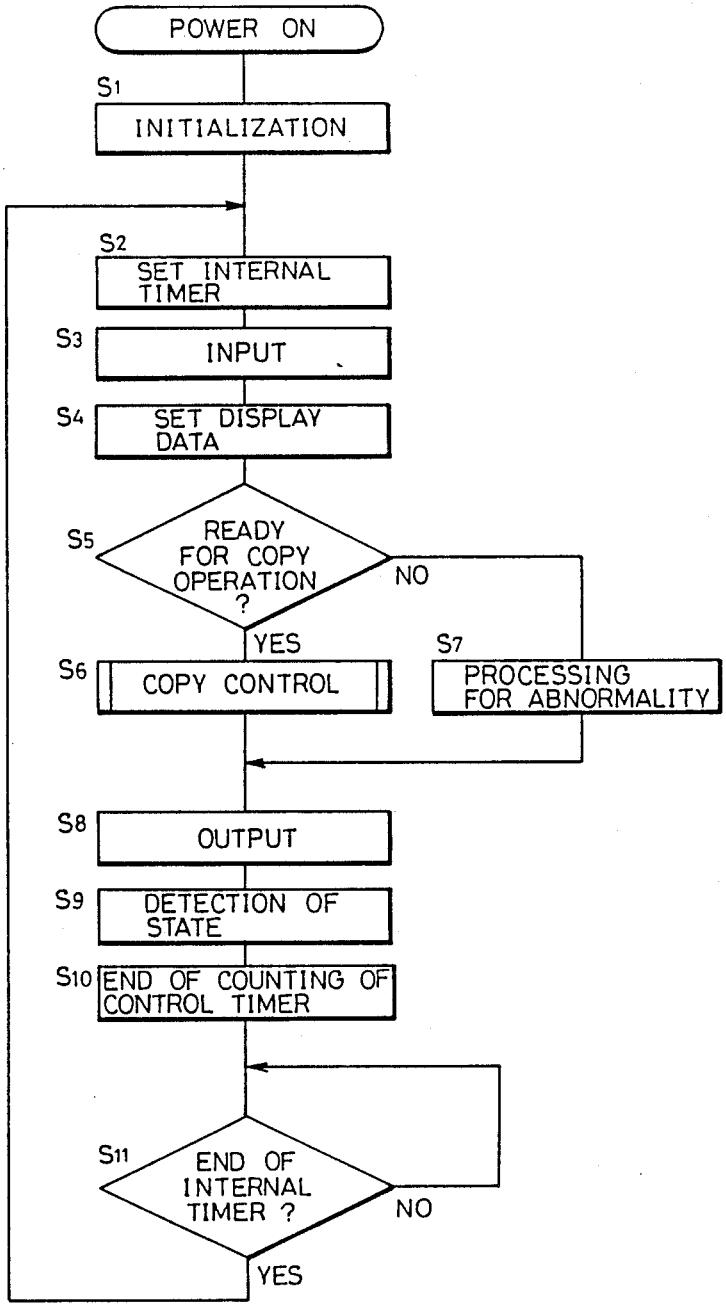
FIG. 11 is a flow chart showing a main routine for controlling the electrophotographic copying apparatus.

FIG. 11 is a flow chart of a main routine for control of copy operation by the microcomputer shown in FIG. 9 or FIG. 10.

When the power source is turned on, a content of a RAM in the microcomputer 200 is cleared and initial values for a normal copy mode are set in the step S1.

Then, an internal timer in the microcomputer 200 is set in the step S2. The timer thus set defines a period required for the below described control, that is, a period of one cycle of the main routine.

In the step S3, input is provided by the keys on the operation panel 60 shown in FIG. 8 and the switch sensors or the like, not shown, in the copying apparatus and in the step S4, processing for display data is effected.

In the steps S5 to S7, it is determined whether the copying apparatus is ready for copy operation. If it is ready for copy operation, control of normal copy operation (including a waiting state) is performed. If not, processing for abnormality is performed in the step of S7.

Then, in the step S8, control signals, display signals and the like are outputted and detection is made in the step S9 as to present states of the copying apparatus, such as an abnormal state, emptiness of toner or emptiness of paper.

Finally, after an end of counting of a timer for control in the step of Sl0, it is determined in the step S11 whether the internal timer comes to an end or not. If it comes to an end, the flow returns to the step S2 and the above described procedures are executed again.

Figure 12:
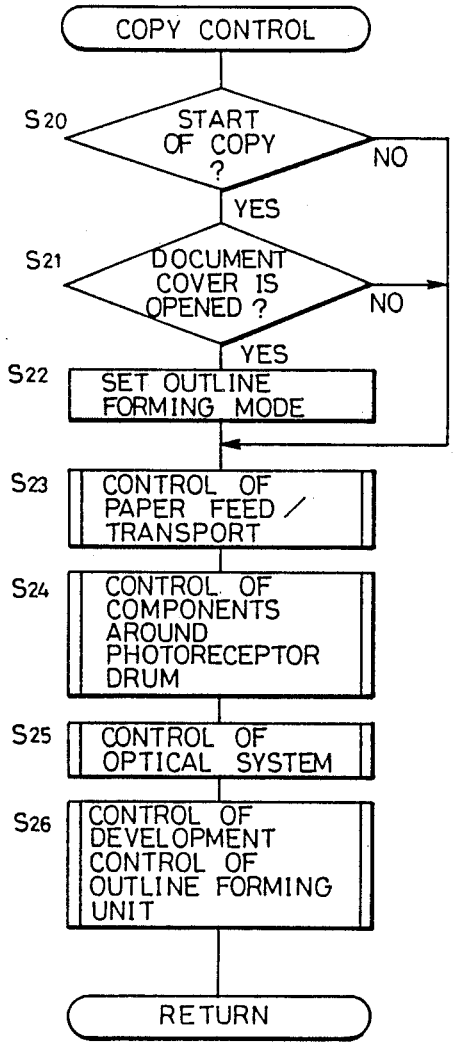
FIG. 12 is a flow chart of a copy control subroutine according to a first embodiment.

First Embodiment:

FIG. 12 is a flow chart of the copy control subroutine in the step S6 of FIG. 11, according to a first embodiment of the invention. In the step S20, it is determined whether copy is to be started or not, that is, whether the print key 61 is pressed or not. At the start of the copy operation, it is determined in the step S21 whether the document cover 26 is opened or not, based on the outputs of the switches 25*a* and 26*b*. If the document cover 26 is opened, the outline forming mode is set in the step S22.

Opening and closing of the document cover 26 may be detected in other methods. For example, a special setting key may be provided on the operation panel so that a signal indicating an opened state of the document cover can be provided when the operator presses this key.

In the subsequent steps S23 to S25, the paper feed and transport system, the components around the photoreceptor drum and the optical system are controlled. In the step S26, the developing unit and the outline forming unit are controlled.

Figure 13:
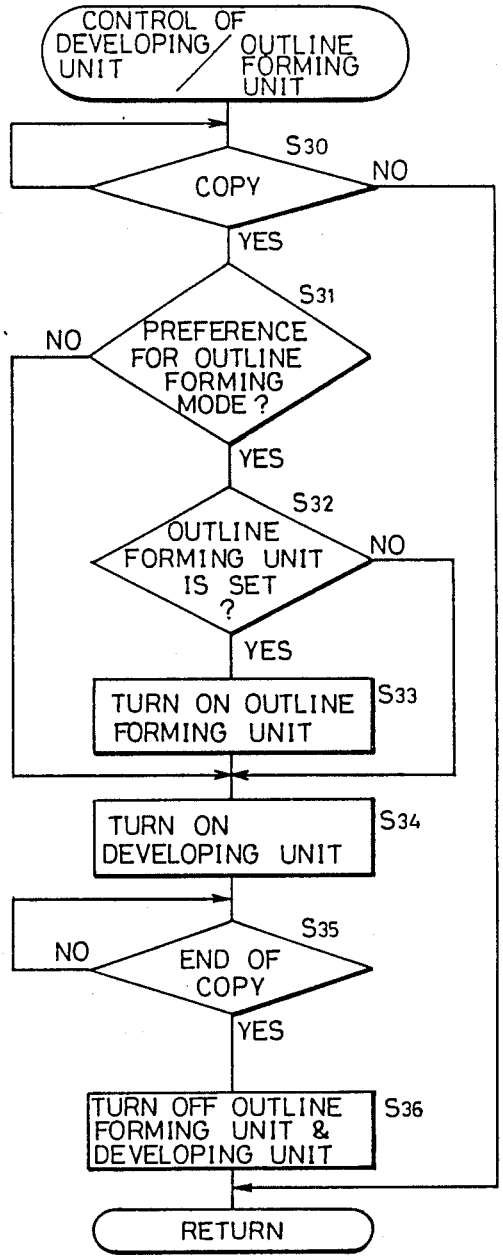
FIG. 13 is a flow chart of a subroutine as an example of control of a developing unit and an outline forming unit.

An example of operation control for the developing unit and the outline forming unit is shown in a subroutine flow chart of FIG. 13.

Referring to FIG. 13, it is determined in the step S30 whether copy operation is enabled or not. If copy operation is enabled, it is determined in the step S31 whether the outline forming mode is preferentially selected or not.

More specifically, since an opened or closed state of the document cover 26 is determined by turn-on or turn-off of the switches 25*a* and 26*b* in the step S22 as described above, the determination in the step S31 is made based on an outline forming mode setting signal for the opened state of the document cover 26.

If the document cover 26 is opened, the outline forming mode is preferentially set. If it is closed, the standard copy mode is preferentially set.

If it is determined in the step 32 that the outline forming unit 8*a* is set, the outline forming unit 8*a* is turned on in the step S33. On the other hand, copy operation in the normal copy mode is performed if the outline image forming mode is not set (in the step S32). When the copy operation is completed (in the step S35), the outline image forming unit and the developing unit are turned off (in the step of S36).

In the above described control procedures, wasteful consumption of toner can be prevented when copy operation is carried out with the document cover being opened.

If copy operation is performed with the document cover being opened when the outline forming unit is not mounted, an alarm may be displayed on the operation panel to warn the user of wasteful consumption of toner.

Second Embodiment:

The second embodiment relates to copy operation in cases in which two facing pages of a book or the like are opened and placed on the document table and copied. In this case, the central portion between the facing pages of the book is depressed, which would cause a shadow by consumption of toner in the prior art. This second embodiment makes it possible to prevent formation of such shadow.

In the second embodiment, the step S21 in the flow chart of FIG. 12 is changed as described below. In this step of the second embodiment, it is determined whether an original to be copied is a bound document such as a book or not. Detection of the book or the like is effected by using contact switches 25 as in the case of detection of the state of the document cover in the above described embodiment or by using a special setting key provided on the operation panel.

Figure 14:
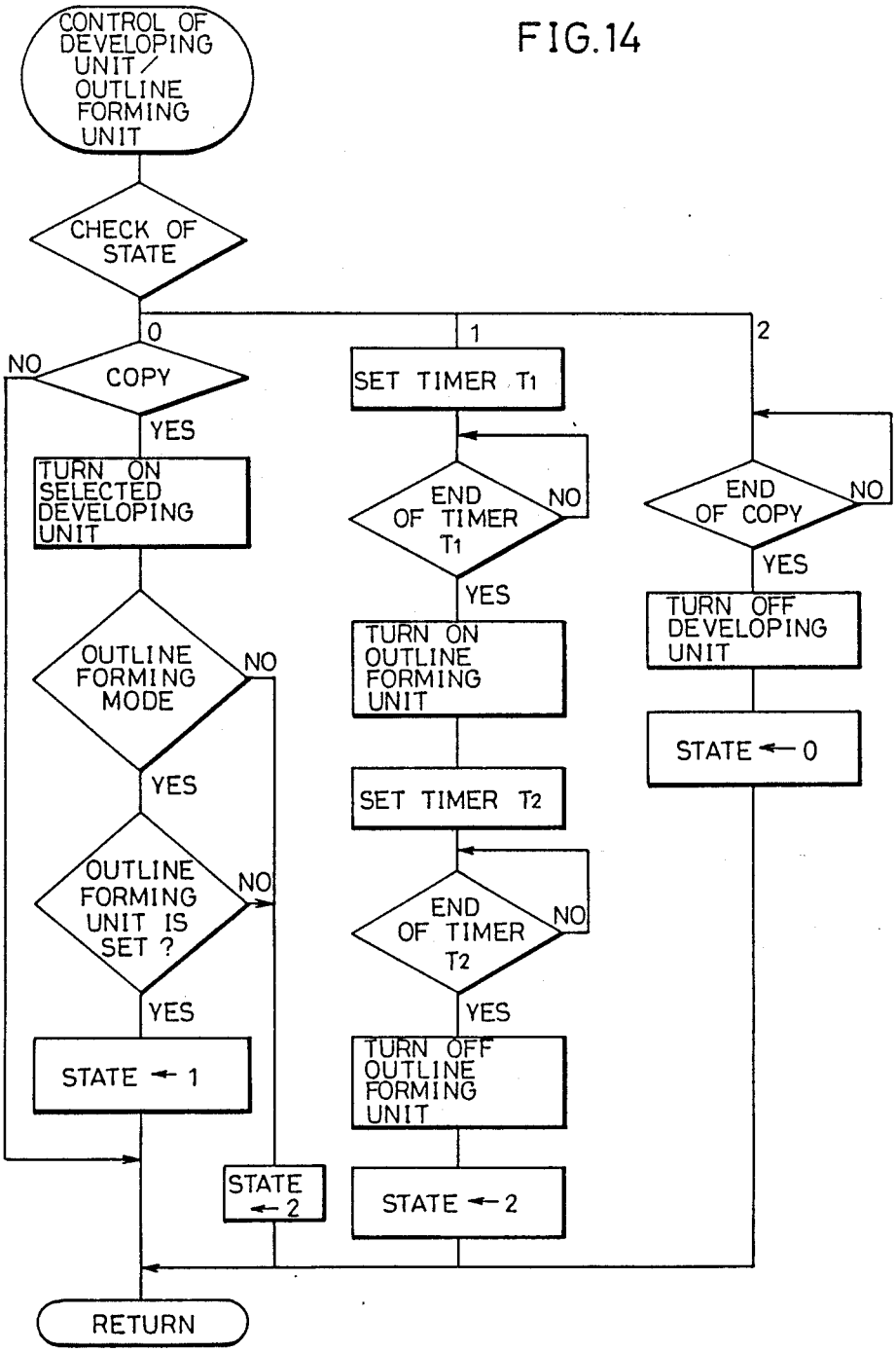
FIG. 14 is a flow chart of a subroutine showing an example of control of a developing unit and an outline forming unit according to a second embodiment of the invention.

The subroutine flow chart for control of the developing unit and the outline forming unit in the step S26 shown in FIG. 12 is changed to a flow chart of FIG. 14 in this second embodiment. More specifically, a state counter is provided to represent a state of the copying apparatus. Thus, the processing flow can be changed according to the value of the state counter as shown in FIG. 14. The initial value of the state counter is 0; when the value of the state counter is 1, an outline image is formed; and when it is 2, a normal image is formed.

Referring to FIG. 14, since the state counter is set to the initial value 0, a routine of a state 0 is executed at first. In the routine of the state 0, the developing unit selected on the operation panel at the start of copy operation is turned on and it is determined whether a book copy mode is selected or not. If the book copy mode is selected, the outline forming mode is preferentially set.

If the outline forming unit 8*a* is mounted, the counter is set to the state 1 and the flow returns to the step S8. If the outline forming unit 8*a* is not mounted, the counter is set to the state 2 and the flow returns to the step S8 and then normal copy operation is performed.

In the routine of the state 1, a timer T1 is set at the same time of turn-on of the developing unit and the outline forming unit 8*a* is turned on at an end of the timer T1. A value of the timer corresponds to a period required for a latent image region formed at turn-on of the outline forming unit to erase the central shadow region of the book. In other words, this value corresponds to a period required for a portion corresponding to the binding margin of the book to reach the scorotron charger. When the outline image forming unit is turned on, a timer T2 is also set and after an end of the timer T2, the outline forming unit 8*a* is turned off to cause the counter to be set to the state 2.

In the routine of the state 2, it is determined whether copy operation is completed and if it is completed, the developing unit is turned off to initialize the state counter to 0.

Figure 15:
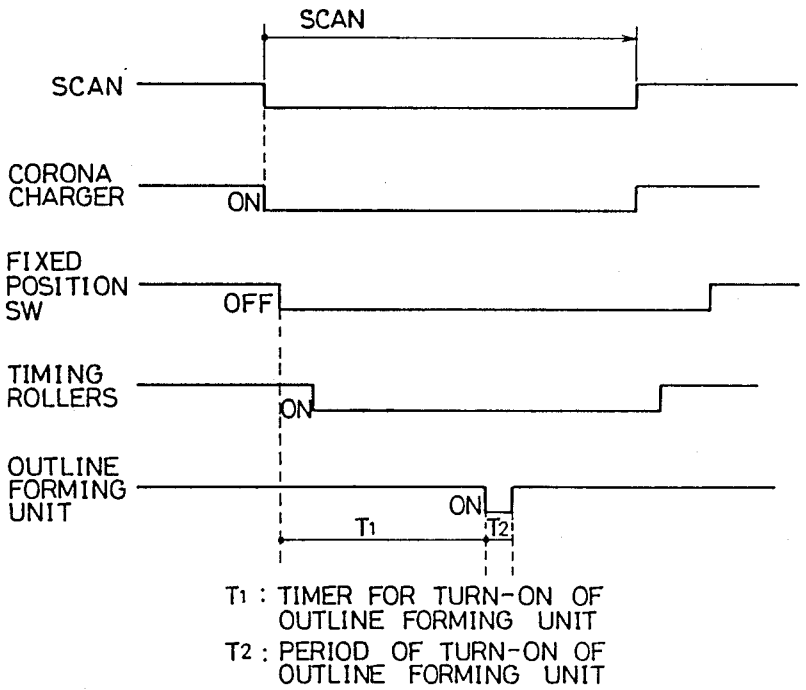
FIG. 15 is a timing chart showing an example of operation timing of an image forming unit in the case of copying a book according to the second embodiment of the invention.

FIG. 15 is a timing chart showing operation timing of the outline forming unit 8*a* in the case of copying a book according to the second embodiment.

As shown in this chart, a distance from a side edge of a book to its center portion and a width of a depressed region of the central portion are evaluated and set by the timers.

Thus, a shadow in the binding margin at the center of the book can be removed at the stage of an electrostatic latent image by using the outline forming unit 8*a*.

The fixed position switch in FIG. 15 is a switch provided in a position for starting scanning of the optical system 10 and it is turned off when scanning of the optical system 10 is started.

Third embodiment:

A third embodiment relates to division copy. If two facing pages of a book or the like is placed on the same plane on the document table, it is sometimes necessary to copy the respective pages separately. Thus, a division copy mode is applied, in which images of the respective two pages are copied separately on two sheets of copy paper. In order to set the division copy mode, a division copy selection key is provided as shown in FIG. 8.

Figure 17:
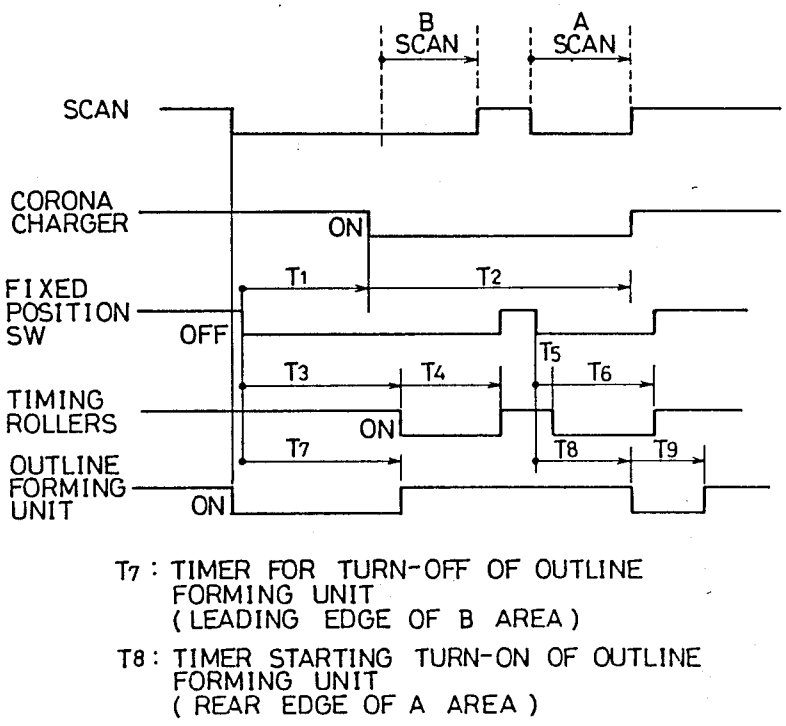
FIG. 17 is a timing chart showing an example of operation timing of an outline forming unit in the case of division copy.
Figure 16:
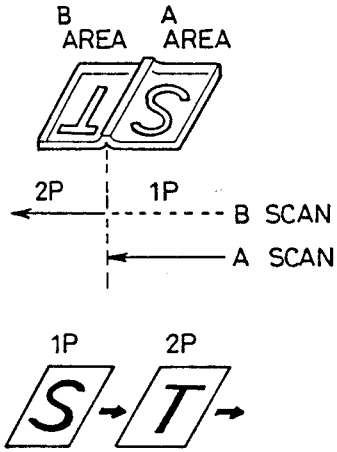
FIG. 16 is an illustration for explaining a principle of division copy according to a third embodiment, indicating a correspondence between an original and copies.

FIG. 16 is an illustration for explaining a concept of division copy, showing a correspondence between the document and the copies. FIG. 17 is a timing chart for showing operation timing of the outline forming unit in the division copy mode.

In this division copy mode, copy operation is generally started from a B area (that is, the second page) so that copies obtained are placed in the serial order of pages. Accordingly, shadows in the center of the book appear at the rear edge of the paper for the A area and at the leading edge of the paper for the B area.

In order to erase such two shadows by using the outline forming unit, control is performed according to the timing chart shown in FIG. 17.

First, after a start of scanning, the fixed position switch which is turned off because the B area is scanned first. At the same time of turn-off of the fixed position switch, the timer T1 starts counting and at the end of counting of the timer T1, the corona charger is turned on to apply a charge necessary for the B area copy to the photoreceptor drum. This corona charger is turned on until an end of scanning of the A area. (The corona charger may be turned off during a period of return of the optical system between the scanning of the B area and the scanning of the A area.)

At the same time of turn-off of the fixed position switch, a timer T3 for enabling an edge of the document to coincide with an edge of transfer paper starts counting. The outline forming unit is turned on until an end of a timer T7 to erase the shadow formed at the leading edge of the B area and thus scanning for the B area is performed.

After completion of the scanning for the B area, the optical system returns to the initial position to turn on the fixed position switch. Then, scanning for the A area is started. After the start of the scanning for the A area, the fixed position switch is turned off again and a timer T5 for turning on the timing roller pair starts counting.

The timing roller pair are turned on during a period of counting of a timer T6 so that the transfer paper is sent onto the transfer charger at the end of counting of the timer T5. At the same time of the turn-off of the fixed position switch for the scanning of the A area, a timer T8 for turning on the outline forming unit starts counting to erase the shadow of the book formed at the rear edge of the A area. At the end of counting of the timer T8, the outline forming unit is turned on for a period of counting of a timer T9 to erase the shadow.

In the above described manner, the shadows formed in the central portion of the book or the like can be erased in the book copy mode.

Figure 18A:
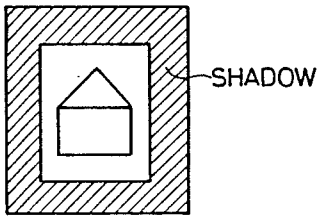
FIGS. 18A and 18B show examples of copying with the cover open in the normal and outline modes, respectively.
Figure 18B:
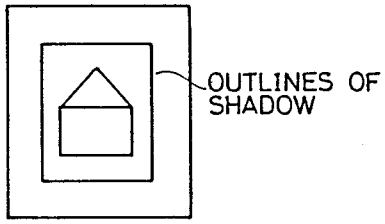

FIG. 18A represents an example of a copy image obtained in the case of copying an original image with a document cover opened in the normal copy mode, and FIG. 18B represents an example of a copy image obtained in the case of copying an original image with a document cover opened in the outline copy mode for forming outline images using the scorotron charger according to the present invention.

Referring to FIG. 18B, in the copying apparatus according to the present invention, any shadow image is not formed in a region to which reflected light is not applied at the time of scanning, even if the original is copied with the document cover being opened. Since only the outline image is formed in that region, consumption of toner is suppressed and the copy image thus obtained has a fine appearance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An electrophotographic copying apparatus comprising:

a photoreceptor drum on which an electrostatic latent image is to be formed, a document placing table on which an original is to be placed, said original including an original image to be copied, a document cover to be opened and closed on said document placing table, cover detection means for detecting an opened or closed state of said document cover, electrostatic latent image forming means for forming, on said photoreceptor drum, an electrostatic latent image corresponding to the original image on said document placing table, outline forming means provided in a position opposed to said photoreceptor drum, for forming only outlines of said original image, and control means for enabling said outline forming means to execute outline copy of said original image when said cover detection means detects the opened state of said cover, whereby an outline image is formed with the outlines of said original image being intensified.

2. An electrophotographic copying apparatus in accordance with claim 1, wherein said outline forming means comprises an outline forming unit for forming outlines of said original image, a unit mounting portion for mounting said outline forming unit in a position opposed to said photoreceptor drum, and unit detection means for detection as to whether said outline forming unit is mounted in said unit mounting portion or not, said outline forming unit comprises a scorotron charger for applying a charge to said photoreceptor drum corresponding to the outlines of said original image, and said control means activates said scorotron charger when said unit detection means detects mounting of said outline forming unit.

3. An electrophotographic copying apparatus in accordance with claim 2, further comprising developing means for forming a normal image other than said outline image, wherein said developing means is able to be mounted in said unit mounting portion, in place of said outline forming unit.

4. An electrophotographic copying apparatus in accordance with claim 3, wherein said normal image is represented by a plurality of developer colors, said developing means includes a plurality of developing units for representing said plurality of developer colors, and said unit detection means detects the developer color of any of said developing units mounted in said mounting portion.

5. An electrophotographic copying apparatus in accordance with claim 4, wherein said outline forming unit and said plurality of developing units provide different binary code signals, and said unit detection means identifies the mounting of said outline forming unit or any of said developing units as well as the developer color of the corresponding developing unit by reading said code signals.

6. An electrophotographic copying apparatus capable of forming an outline image with outline portions intensified by applying a desired charge by a scorotron charger to an electrostatic latent image formed on a photoreceptor drum comprising:

a document placing table on which an original is to be placed, said original including a book having a binding margin book signal generating means for generating a book signal when said original is a book, said book including an original image, electrostatic latent image forming means for forming, on said photoreceptor drum, an electrostatic latent image corresponding to said original image on said document placing table, outline forming means provided in a position opposed to said photoreceptor drum, for forming only outlines of said original image, and control means for activating said outline forming means with respect to a binding margin area of said book to execute outline copy of said original image when said book signal generating means generates the book signal.

7. An electrophotographic copying apparatus in accordance with claim 6, wherein said outline forming means comprises an outline forming unit for forming outlines of said original image, a unit mounting portion for mounting said outline forming unit in a position opposed to said photoreceptor drum, and unit detection means for detection as to whether said outline forming unit is mounted in said unit mounting portion, said outline forming unit includes a scorotron charger for applying a charge to said photoreceptor drum corresponding to outline portions of said original image, and said control means activates said scorotron charger when said unit detection means detects mounting of said outline forming unit.

8. An electrophotographic copying apparatus in accordance with claim 7, further comprising developing means for forming a normal image other than the outline image of said book, wherein said developing means is able to be mounted in said unit mounting portion, in place of said outline forming unit.

9. An electrophotographic copying apparatus in accordance with claim 6, further comprising developing means for forming a normal image other than said outline image, wherein said developing means is able to be mounted in said unit mounting portion, in place of said outline forming unit.

10. An electrophotographic copying apparatus in accordance with claim 7, wherein said normal image is represented by a plurality of developer colors, said developing means includes a plurality of developing units for representing said plurality of developer colors, and said unit detection means detects the developer color of any of said developing units mounted in said mounting portion.

11. An electrophotographic copying apparatus in accordance with claim 6, further comprising a document cover to be opened and closed on said document placing table, wherein said book signal generating means includes detection means for detecting an opened or closed state of said document cover.

12. An electrophotographic copying apparatus capable of forming an outline image with outline portions being intensified by applying a desired charge by a scorotron charger to an electrostatic latent image formed on a photoreceptor drum, comprising:

a document placing table on which an original is to be placed, said original including a book having a binding margin, said book including an original image, and including a first page and a second page facing each other, book division copy mode designation input means for designating a book division copy mode for copying said first and second pages on different copy areas, electrostatic latent image forming means for forming, on said photoreceptor drum, an electrostatic latent image corresponding to said original image on said document placing table, outline forming means provided in a position opposed to said photoreceptor drum, for forming only outlines of said original image, and control means for activating said outline forming means to execute outline copy of said original image when the book division copy mode is designated by said book division copy mode designation input means.

13. An electrophotographic copying apparatus in accordance with claim 1, wherein said outline forming means comprises an outline forming unit for forming outlines of said original image, a unit mounting portion for mounting said outline forming unit in a position opposed to said photoreceptor drum, and unit detection means for detection as to whether said outline forming unit is mounted in said unit mounting portion, said outline forming unit includes a scorotron charger for applying a charges to said photoreceptor drum corresponding to outline portions of said original image, and said control means activates said scorotron charger when said unit detection means detects mounting of said outline forming unit.

14. An electrophotographic copying apparatus in accordance with claim 13, further comprising developing means for forming a normal image other than said outline image, wherein said developing means is able to be mounted in said unit mounting portion, in place of said outline forming unit.

15. An electrophotographic copying apparatus in accordance with claim 14, wherein said normal image is represented by a plurality of developer colors, said developing means includes a plurality of developing units for representing said plurality of developer colors, and said unit detection means detects the developer color of any of said developing units mounted in said mounting portion.

16. An electrophotographic copying apparatus in accordance with claim 15, wherein said outline forming unit and said plurality of developing units provide different binary code signals, and said unit detection means identifies the mounting of said outline forming unit or any of said developing units as well as the developer color of the corresponding developing unit by reading said code signals.

17. An electrophotographic copying apparatus comprising:

a document placing table on which an original having an original image is to be placed, a photoreceptor drum to be rotated, charging means for charging said photoreceptor drum with a predetermined potential, exposure means for scanning said original image, exposing said photoreceptor drum charged by said charging means and forming an electrostatic latent image on said photoreceptor drum, a scorotron charger for applying, to said electrostatic latent image, a charge of a polarity opposite to that of said charging means, said scorotron charger including grid electrode, to which a voltage lower than a potential of the electrostatic latent image is applied, developing means for developing said electrostatic latent image, a document cover provided to be opened and closed on said document placing table, detection means for detecting an opened and closed state of said document cover, and control means for operating said charging means, said exposure means, said scorotron charger and said developing means according to a predetermined sequence and selecting an outline copy mode for copying said original image when said detection means detects the opened state of said document cover, and operating said charging means, said exposure means and said developing means according to a predetermined sequence and selecting a normal copy mode for copying said original image when said detection means detects the closed state of said document cover.

18. An electrophotographic copying apparatus in accordance with claim 17, wherein a mounting portion is provided in said electrophotographic copying apparatus and said scorotron charger is detachably mounted in said mounting portion.

19. An electrophotographic copying apparatus comprising:

a document placing table on which an original having an original image is to be placed, said original including a book, a photoreceptor drum to be rotated, charging means for charging said photoreceptor drum with a predetermined potential, exposure means for scanning said original image, exposing said photoreceptor drum charged by said charging means and forming an electrostatic latent image on said photoreceptor drum, a scorotron charger for applying, to said electrostatic latent image, a charge of a polarity opposite to that of said charging means, said scorotron charger including a grid electrode, to which a voltage lower than a potential of said electrostatic latent image is applied, developing means for developing said electrostatic latent image, book signal generating means for generating a book signal indicating a book when said original is the book, control means for operating said charging means, said exposure means, said scorotron charger and said developing means according to a predetermined sequence and selecting an outline copy mode for copying said original image when said book signal is generated, and operating said charging means, said exposure means and said developing means according to a predetermined sequence and selecting a normal copy mode for copying said original image when said book signal is not generated.

20. An electrophotographic copying apparatus in accordance with claim 19, wherein a mounting portion is provided in said electrophotographic copying apparatus and said scorotron charger is detachably mounted in said mounting portion.

21. An electrophotographic copying apparatus in accordance with claim 20, further comprising a document cover to be opened and closed on said document placing table, wherein said book signal generating means includes detection means for detecting an opened or closed state of said document cover.

* * * * *